US006012287A

United States Patent [19]

Sims

[11] Patent Number: 6,012,287

[45] Date of Patent: Jan. 11, 2000

[54] FLUID ACTUATOR SYSTEM HAVING MEANS FOR INTERNALLY INCREASING THE FLUID PRESSURE THEREIN

[76] Inventor: James O. Sims, 1100 Brooks St., Decatur, Ala. 35601

[21] Appl. No.: 08/910,543

[22] Filed: Jul. 17, 1997

[51] Int. Cl.[7] ..... F15B 7/08

[52] U.S. Cl. ..... 60/560; 60/563; 60/583

[58] Field of Search ..... 60/560, 563, 565, 60/583

[56] References Cited

U.S. PATENT DOCUMENTS

| | | | |
|---|---|---|---|
| 2,580,353 | 12/1951 | Hunt | 60/563 |
| 4,153,180 | 5/1979 | Fernique | 60/560 |
| 5,247,870 | 9/1993 | Brasca et al. | 60/560 |

*Primary Examiner*—F. Daniel Lopez

*Attorney, Agent, or Firm*—John C. Garvin, Jr.; Waddey & Patterson, P.C.; Harold W. Hilton

[57] ABSTRACT

A fluid actuator system disposed for internally increasing fluid pressure therein. The system includes a first fluid actuator including a cylinder provided with a first axial bore having a first piston and piston rod reciprocally mounted therein. The first cylinder is provided with first and second inlet and outlet fluid passages communicating into the first axial bore for directing fluid in and out of the first axial bore. A second fluid actuator is provided which has a cylinder provided with a second axial bore having a second piston and piston rod reciprocally mounted therein. The second cylinder is provided with third and fourth inlet and outlet fluid passages communicating into the second axial bore for directing fluid in and out of the second axial. An end closure assembly common to the first and second cylinders for sealing one end of each of the cylinder is provided. The end closure assembly includes structure therein for internally increasing fluid pressure of the fluid actuator system.

2 Claims, 2 Drawing Sheets

FLUID ACTUATOR SYSTEM HAVING MEANS FOR INTERNALLY INCREASING THE FLUID PRESSURE THEREIN

FIELD OF THE INVENTION

The present invention generally relates to fluid actuators and more particularly to fluid actuator systems having means for internally increasing the fluid pressure of the system.

BACKGROUND OF THE INVENTION

Typically, pistons have been used to extend a piston rod out of a cylinder for providing the force necessary to perform a variety of functions. Some of these functions include compressing materials to produce bricks, stamping, shearing, forming, etc. In performing such functions the output force provided at the end of the piston rod must be of a predetermined high magnitude thereby requiring the fluidic working pressure of the fluid actuator to be very high. However, the fluid actuator, in order to provide such high pressure outputs, necessarily must be very large to handle such high working pressures. Additionally, the external fluid lines must also be very large and bulky to convey the fluid under the required working pressure into the cylinder of the fluid actuator.

The present invention overcomes the above noted difficulties by providing a fluid actuator system with means for internally increasing the fluid pressure therein.

The fluid actuator system of the present invention includes a pair of fluid actuators defined by a pair of cylinders having bores which are disposed for communication with each other. Each cylinder is provided with fluid inlets and outlets and the bore of each cylinder has a piston and piston rod reciprocally mounted therein. An end closure assembly, common to both actuators, includes a member which is provided with an axial bore to receive the piston rod of the first fluid actuator therein responsive to displacement of the piston/piston rod by working fluid pressure. The fluid inlet of the second cylinder is also provided in the end closure member and directs working fluid into the axial bore of the closure member and the second cylinder prior to the piston and piston rod of the first fluid actuator being displaced. Responsive to movement of the piston rod of the first fluid actuator into the bore of the end closure member, fluid in the axial bore of the end closure member forced against the piston face of the piston of the second fluid actuator for displacement of the piston rod of the second fluid actuator.

SUMMARY OF THE INVENTION

The present fluidic actuator system provides for increasing the output pressure of a second fluid actuator which has a bore in communication with the bore of a first fluid actuator. Both bores have discrete piston and piston rod assemblies therein and both bores receive the same working pressure from the source of fluid pressure.

It is, therefore, an object of the present invention to provide a fluid actuator system in which the working pressure of the system is internally increased.

DETAILED DESCRIPTION OF THE INVENTION

Figure 1:
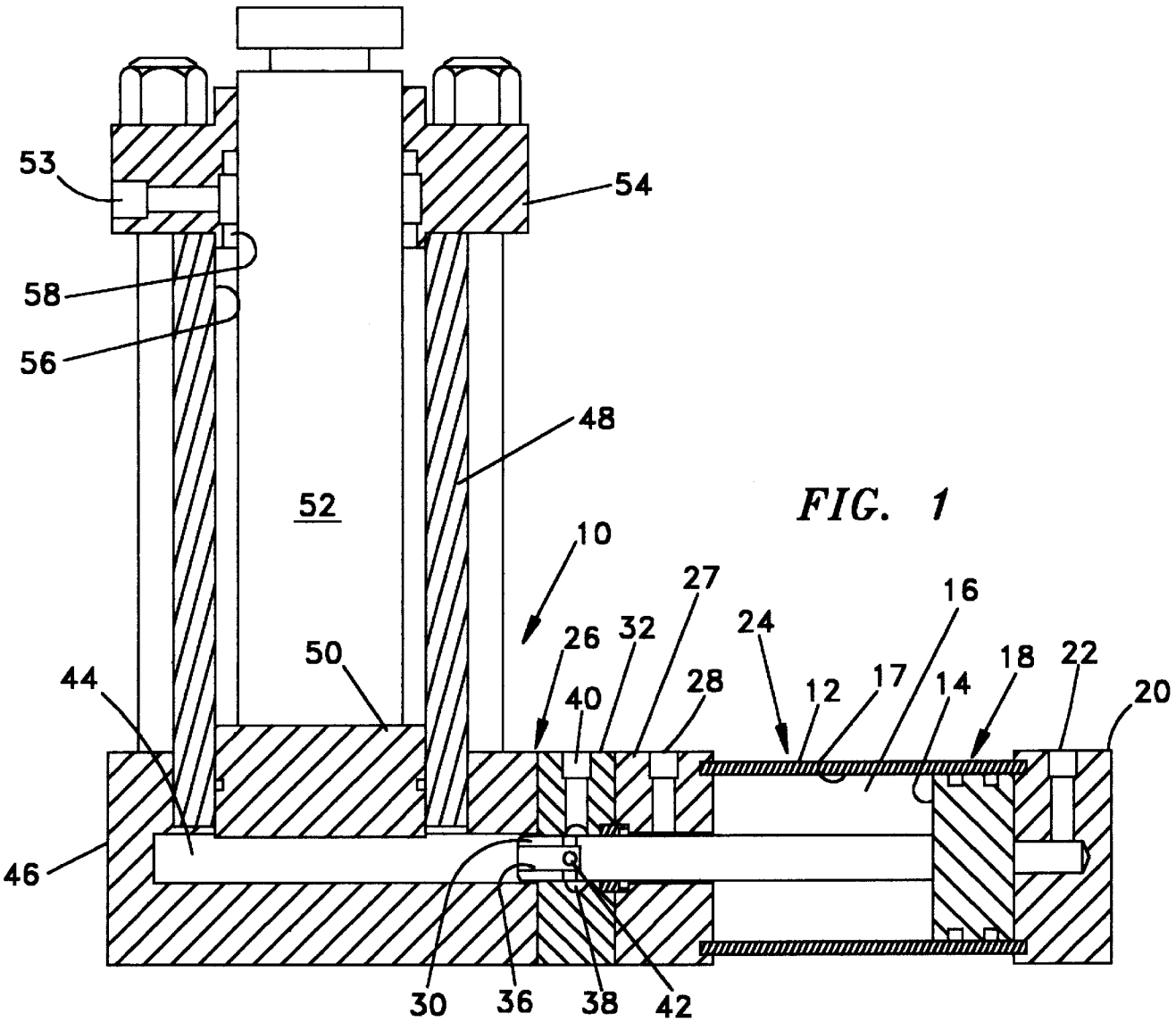
FIG. 1 is an elevational, sectional view of the fluid actuator system of the present invention.

As seen in FIG. 1, a fluid actuator system 10 is shown to include a first cylinder 12 enclosing a piston 14 and piston rod 16, which are mounted in a bore 17 of cylinder 12. Cylinder 12 is provided at one end 18 with an end closure member 20 having a fluid passage 22 therein. At the second end 24 of cylinder 12 is an end closure assembly 26 including a rod supporting member 27 having a fluid passage 28 therein. Fluid passages 22 and 28 communicate into bore 17 on opposite sides of piston 14.

Piston rod 16 includes an end portion 30 which extends out of cylinder 12 and into end closure assembly 26. A piston rod support member 32 is provided in closure assembly 26 for support of end portion 30 of piston rod 14. An axial bore 36 is provided in the end portion 30 of piston 14 and an annular port 38 is provided in rod support member 32 into which a fluid passage 40 of rod support member 32 communicates. A plurality of radially extending ports 42 is provided in end portion 30 of piston and communicates into bore 36 of rod 14. Piston rod 14 is reciprocally carried in cylinder 12 and moves the radially extending ports 42 into and out of registry with annular port 38 and fluid passage 40, for reasons explained hereinbelow.

Bore 17 of cylinder 12 communicates into a bore 44 provided in a member 45 of end closure assembly 26 which is common to cylinder 12 and a second cylinder 48. The first and second cylinders are substantially perpendicular to each other. A piston 50 and piston rod 52 is reciprocally mounted in second cylinder 48. A fluid passage 53 is provided in an end closure member 54 of cylinder 48 in communication with the bore 56 of cylinder 48 through an annular passage 58 provided in an inner surface of end cap 54.

Figure 2:
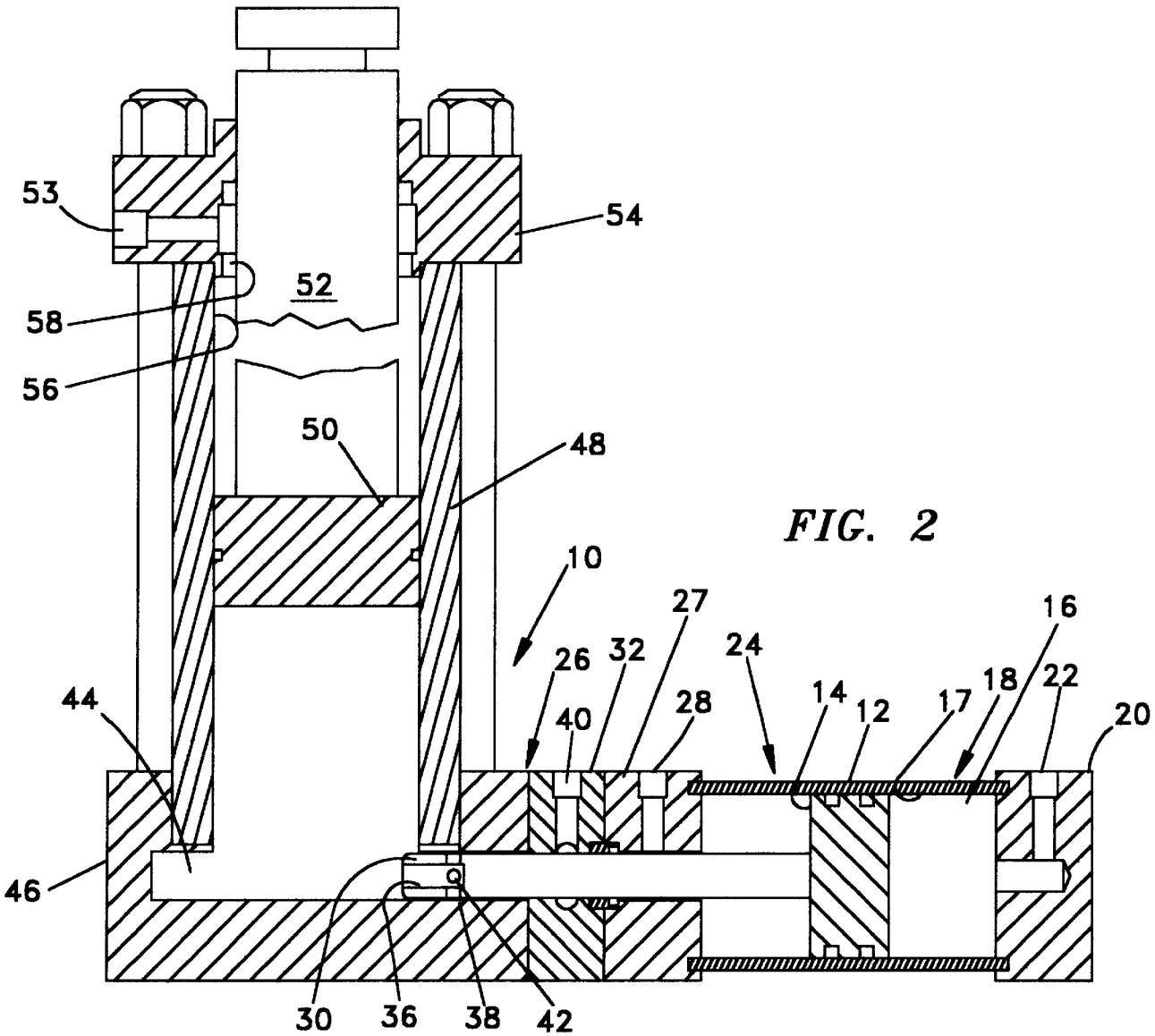
FIG. 2 is an enlarged partial view of the fluid actuator system of FIG. 1 illustrating the piston rod of one fluid actuator being displaced into an axial bore of an end closure assembly which is common to both fluid actuators of the fluid actuator system of the present invention.

FIG. 2 is a view similar to FIG. 1 with the piston 14 and piston rod 16 of cylinder 12 displaced as a result of working fluid pressure being received through fluid passage 22 to the face of piston 14. As can be seen in FIG. 2, fluid passages 40 no longer communicate into the radial passages 42 of piston rod 16 and the piston rod extends into bore 44 to displace fluid therein against the face of piston 50 which moves piston rod 52 to further extend end 53 out of cylinder 48.

In operation, fluid at a predetermined working pressure is directed into bore 44 of end cap assembly 46 through fluid passage 40, radial passages 42 and bore 36 of rod 16. Fluid at the same predetermined working pressure is also directed through fluid passage 22 against piston 14 to displace the piston 14 and the piston rod 16. Rod 16 is moved into bore 44 of end cap member 46 as a result of this displacement. The rod displaces the fluid in bore 44 against the face of piston 50 in cylinder 48 to move the piston 50 and rod 52.

An example of the internal fluid pressure increases are as follows:

Assume that piston 14 has a 3.25" diameter which provides a piston area of 8.296". Now assume that the piston rod 16 has a 1.375" diameter which provides a rod area of 1.485". Therefore, a 5.587 to 1 ratio exists between piston 14 and rod 16. Now assume that fluid at a 3000 PSI working pressure is directed in cylinder 12 through passage 22 to move the piston 14 and rod 16 to the left as shown in FIG. 2. Piston rod 16 is inserted into bore 44 which has been filled with fluid through passage 40 at 3000 PSI working pressure. Therefore, it can be seen that 3000 PSI×5.587 =16,760 PSI output pressure being applied against the face of piston 50 of cylinder 48. This increased input pressure against the face of piston 50 also greatly increases the output pressure of piston 50 in accordance with the ratio between the areas of rod 52 and piston 50 in the manner described above in conjunction between piston 14 and rod 16. For example, if the second piston 50 and rod 52 is provided with a 12.566 to 1 ratio then the pressure in cylinder 48 is increased to 210,600 PSI (piston/piston rod ratio×16,760 PSI input pressure against piston 50).

I claim:

1. A fluid actuator system disposed for internally increasing fluid pressure therein, comprising:

a first fluid actuator including a first cylinder provided with a first axial bore having a first piston and piston rod reciprocally mounted therein, said first piston rod having a first end secured to said first piston and a second distal end, said distal end having an axial bore therein and a plurality of radially extending bores communicating into said axial bore, said first cylinder having first and second inlet and outlet fluid passages communicating into said first axial bore for directing fluid in and out of said first axial bore;

a second fluid actuator including a second cylinder provided with a second axial bore having a second piston and piston rod reciprocally mounted therein, said second cylinder having third and fourth inlet and outlet fluid passages communicating into said second axial bore for directing fluid in and out of said bore second axial of said second cylinder, wherein said first and second cylinders are substantially perpendicular to each other; and end closure means including an assembly common to said first and second cylinders and disposed for sealing one end of each said cylinder, said end closure means including a member for support of said distal end of said first piston rod, said member having a third fluid passage for directing fluid into said second axial bore of said second cylinder responsive to alignment of said third fluid passage with said axial bores of said second piston, said end closure member having an axial bore therein to receive fluid from said third fluid passage for displacement of said second piston.

2. A fluid actuator system of claim 1 wherein said first piston rod is provided with a predetermined diameter and said second piston rod is provided with a predetermined diameter, said predetermined diameter have a specific ratio.

* * * * *